US007195397B2

(12) United States Patent
Williamson et al.

(10) Patent No.: US 7,195,397 B2
(45) Date of Patent: Mar. 27, 2007

(54) BULK BAG FOR MEAT AND MEAT PRODUCTS

(75) Inventors: Robert R. Williamson, Dallas, TX (US); Joe Ronald Richardson, Jr., Sadler, TX (US); Bradley Matthew Eisenbarth, Sherman, TX (US); Bobby Glenn Brown, Dennison, TX (US)

(73) Assignee: B.A.G. Corp., Dallas, TX (US)

( * ) Notice: Subject to any disclaimer, the term of this patent is extended or adjusted under 35 U.S.C. 154(b) by 502 days.

(21) Appl. No.: 10/769,168

(22) Filed: Jan. 30, 2004

(65) Prior Publication Data

US 2004/0184679 A1 Sep. 23, 2004

Related U.S. Application Data

(63) Continuation-in-part of application No. 10/689,278, filed on Oct. 20, 2003, now Pat. No. 7,086,781, which is a continuation-in-part of application No. 10/436,761, filed on May 13, 2003, now Pat. No. 6,921,201, which is a continuation-in-part of application No. 10/253,086, filed on Sep. 24, 2002, now Pat. No. 6,739,753.

(60) Provisional application No. 60/389,865, filed on Jun. 20, 2002, now abandoned.

(51) Int. Cl.

| | |
|---|---|
| ***B65D 33/00*** | (2006.01) |
| ***B65D 30/22*** | (2006.01) |
| ***B65D 30/08*** | (2006.01) |
| ***B65D 33/02*** | (2006.01) |
| ***B65D 25/00*** | (2006.01) |

(52) U.S. Cl. ..... 383/33; 383/38; 383/109; 383/119; 220/9.4

(58) Field of Classification Search ..... 383/104, 383/119, 38, 117, 33, 109; 220/9.1–9.4
See application file for complete search history.

(56) References Cited

U.S. PATENT DOCUMENTS

| | | | |
|---|---|---|---|
| 3,105,617 | A | 10/1963 | Pelldin |
| 3,961,655 | A | 6/1976 | Nattrass et al. |
| 4,493,109 | A | 1/1985 | Nattrass |
| 4,597,102 | A | 6/1986 | Nattrass |
| 4,610,028 | A | 9/1986 | Nattrass |
| 4,658,432 | A | 4/1987 | Lehmann et al. |
| 4,703,517 | A | 10/1987 | Marino |
| 4,730,942 | A | 3/1988 | Fulcher |
| 4,781,472 | A | 11/1988 | LaFleur et al. |
| 4,901,885 | A | 2/1990 | Boots |
| 4,927,037 | A | 5/1990 | Boots |
| 5,025,925 | A | 6/1991 | Wiklund |

(Continued)

FOREIGN PATENT DOCUMENTS

| | | |
|---|---|---|
| CA | 2416049 | 12/2003 |

(Continued)

*Primary Examiner*—Jes F. Pascua
(74) *Attorney, Agent, or Firm*—Michael A. O'Neil

(57) ABSTRACT

A bulk bag comprises a side wall formed from woven polypropylene fabric and comprising a cylindrical configuration. Long, narrow, strips of polypropylene fabric is sewn to the side wall panels at spaced apart locations to define pockets which receive support members. Alternatively, the pockets may be formed by gathering the fabric of the side wall to define the pocket and securing the gathered material in place by sewing.

2 Claims, 6 Drawing Sheets

U.S. PATENT DOCUMENTS

| | | | | |
|---|---|---|---|---|
| 5,052,579 | A | 10/1991 | Boots | |
| 5,104,236 | A | 4/1992 | LaFleur | |
| 5,289,937 | A | 3/1994 | Boots | |
| 5,323,922 | A | 6/1994 | Lapoint et al. | |
| 5,423,611 | A | 6/1995 | Sherrard | |
| 5,607,237 | A | 3/1997 | LaFleur | |
| 5,762,421 | A | 6/1998 | Ross | |
| 6,015,057 | A | 1/2000 | Stone et al. | |
| 6,056,440 | A | 5/2000 | Nattrass | |
| 6,203,198 | B1 | 3/2001 | Stone | |
| 6,220,755 | B1 | 4/2001 | Brown et al. | |
| 6,224,260 | B1 | 5/2001 | Nickell et al. | |
| 6,244,443 | B1 | 6/2001 | Nickell et al. | |
| 6,402,378 | B1 | 6/2002 | Shackleton | |
| 6,415,927 | B1 | 7/2002 | Stone et al. | |
| 6,739,753 | B2 | 5/2004 | Richardson, Jr. et al. | |
| 6,921,201 | B2 | 7/2005 | Richardson, Jr. et al. | |
| 7,018,098 | B2 | 3/2006 | Richardson, Jr. et al. | |
| 7,086,781 | B2 * | 8/2006 | Richardson et al. | 383/38 |
| 2001/0000712 | A1 | 5/2001 | Nickell et al. | |
| 2001/0004058 | A1 | 6/2001 | Nickell et al. | |
| 2001/0041023 | A1 | 11/2001 | Brown et al. | |
| 2002/0008517 | A1 | 1/2002 | Derby et al. | |
| 2002/0170844 | A1 | 11/2002 | Stone et al. | |
| 2003/0235349 | A1 | 12/2003 | Richardson, Jr. et al. | |
| 2003/0235350 | A1 | 12/2003 | Richardson, Jr. et al. | |
| 2004/0040883 | A1 | 3/2004 | Stone et al. | |
| 2004/0081374 | A1 | 4/2004 | Richardson, Jr. et al. | |
| 2004/0151404 | A1 | 8/2004 | Richardson, Jr. et al. | |
| 2004/0184679 | A1 | 9/2004 | Williamson et al. | |
| 2004/0264814 | A1 | 12/2004 | Eisenbarth et al. | |
| 2005/0063623 | A1 | 3/2005 | Eisenbarth et al. | |

FOREIGN PATENT DOCUMENTS

| | | |
|---|---|---|
| CA | 2460758 | 11/2004 |
| DE | 69306268 | 1/1997 |
| EP | 0552845 | 7/1993 |
| EP | 1375387 | 1/2004 |
| EP | 1477428 | 11/2004 |
| FI | 863992 | 3/1988 |
| JP | 7251895 | 10/1995 |
| JP | 2002019879 | 1/2002 |
| NL | 9200130 | 8/1993 |
| WO | WO 89/09171 | 10/1989 |
| WO | WO 01/42098 | 6/2001 |

* cited by examiner

BULK BAG FOR MEAT AND MEAT PRODUCTS

CROSS-REFERENCE TO RELATED APPLICATIONS

This application is a continuation-in-part application of application Ser. No. 10/689,278 filed Oct. 20, 2003, now U.S. Pat. No. 7,086,781, which is a continuation-in-part of application Ser. No. 10/436,761 filed May 13, 2003, now U.S. Pat. No. 6,921,201, which is a continuation-in-part of application Ser. No. 10/253,086 filed Sep. 24, 2002, now U.S. Pat. No. 6,739,753 which is a utility application comprising a continuation-in-part of prior provisional application Ser. No. 60/389,865 filed Jun. 20, 2002, abandoned.

TECHNICAL FIELD

This invention relates generally to bulk bags, and more particularly to a bulk bag construction that is particularly adapted for use in conjunction with meat and meat products.

BACKGROUND AND SUMMARY OF THE INVENTION

Heretofore meat and meat products have been transported in large cardboard boxes which are mounted on wooden pallets. As is well known, both cardboard and wood can and do harbor microorganisms, insects, etc. The presence of such organisms in and around containers utilized to receive, store, transport, and discharge meat and meat products can lead to contamination thereof. Total freedom from contamination is an absolute necessity in the food industry. Therefore, a need exists for a container adapted to receive, store, transport and discharge meat and meat products which is incapable of harboring contaminating organisms.

Pending U.S. application patent application Ser. No. 10/436,761, which is assigned to the assignee hereof, discloses a bulk bag in which the fabric of the side wall panels comprising the bulk bag is formed into four vertically extending pockets. The pockets receive supporting members formed from PVC pipe or similar materials. The function of the supporting members is to maintain the bulk bag in an upright configuration thereby facilitating the receipt of meat and meat products therein.

The present invention comprises an improvement over the bulk bag construction disclosed and claimed in the above-identified co-pending application. In accordance with the present invention, vertically extending pockets are provided at spaced apart locations around the periphery of the bulk bag. The pockets receive supporting members formed from PVC pipe or similar materials which function to maintain the bulk bag in an upright configuration. The pockets may also receive legs depending from a frame which secures the bulk bag in an open configuration during the filling of the bulk bag with meat and meat products.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
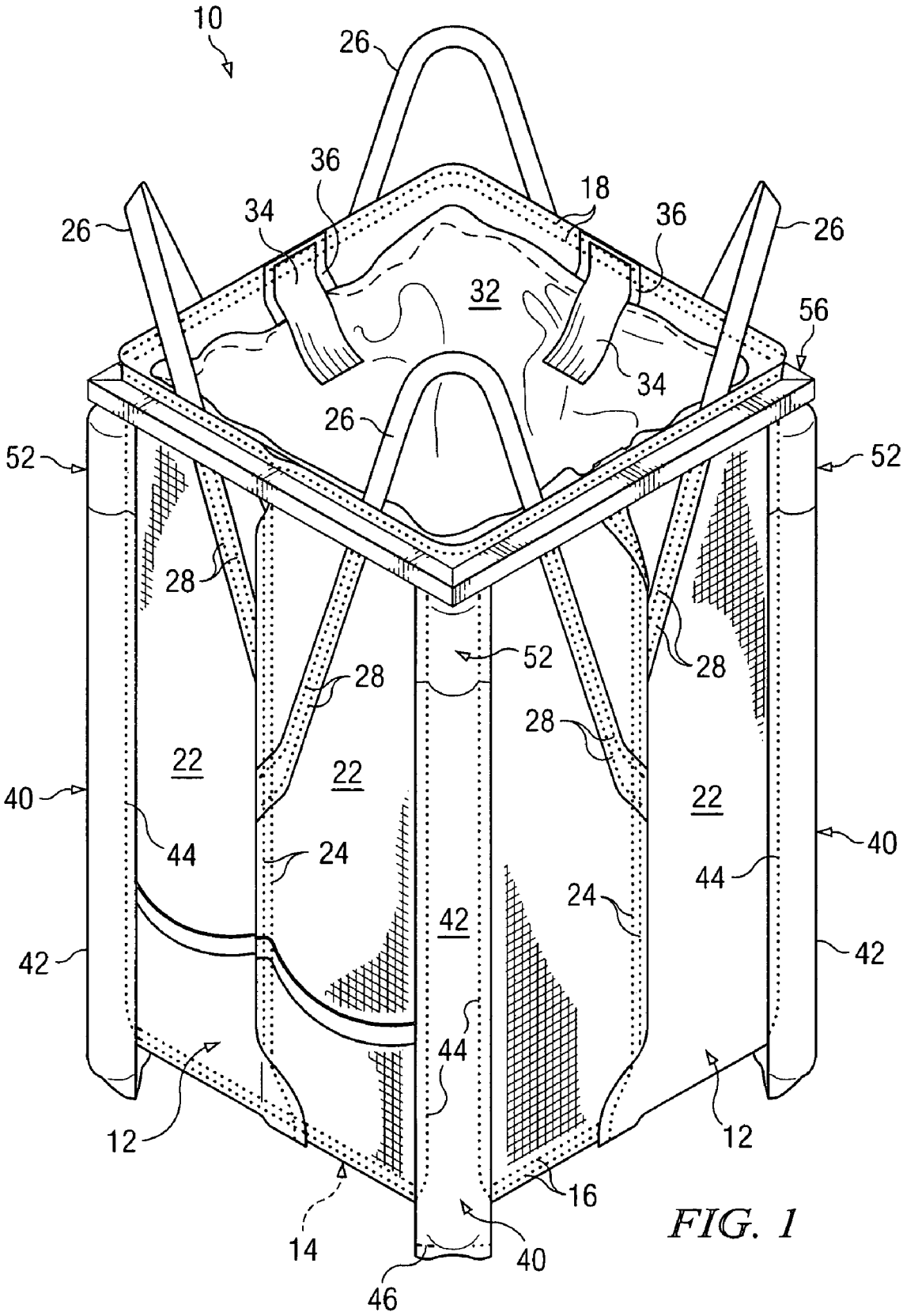
FIG. 1 is a perspective view of a bulk bag constructed in accordance with a first embodiment of the present invention.

Referring now to the Drawings, and particularly to FIG. 1 thereof, there is shown a bulk bag 10 incorporating a first embodiment of the present invention. The bulk bag 10 comprises four side walls 12 and a bottom wall 14 which is secured to the lower ends of the side walls 12 by sew lines 16. The upper ends of the side walls 12 are folded over and secured by sew lines 18 to provide reinforced upper edges.

In the drawings the side walls 12 are shown arranged in a geometrical configuration comprising a square, however, it will be understood that the side walls can be arranged in other geometrical configurations depending upon the requirements of particular applications of the invention. Similarly, the bulk bag 10 as shown is comprising four corners located at the intersections of the side walls 12. However, the exact number of corners comprising the bulk bag 10 may be more or less than four depending upon the geographical configuration defined by the side walls 12.

The side walls 12 comprise four side wall panels 22 which are secured together end-to-end by sew lines 24. The side wall panels 22 are preferably manufactured from woven polypropylene fabric although other materials may be utilized in the construction of the bulk bag 10, if desired. As will be evident from the drawings, the side wall panels 22 extend around the corners defined by the side walls 12.

The bulk bag 10 further comprises four lift loops 26 which are formed from webbing of the type utilized in the manufacture of automotive and aircraft seatbelts and in similar applications. The lift loops are secured to the side wall panels 22 by sew lines 28 and are further secured by the sew lines 24 which define the side wall seams.

The bulk bag 10 further comprises a liner 32 which may be formed from polyethylene film. Other types of plastic film may also be used in the manufacture of the liner 32 depending upon particular applications of the invention. The liner 32 is secured within the interior of the bulk bag 10 by lengths of fiber reinforced plastic tape 34 which are adhesively secured to the film comprising the liner 32. The lengths of tape 34 are in turn secured to the side walls 12 of the bulk bag 10 by the sew lines 18. Small sections of woven polypropylene fabric 36 are utilized to prevent the lengths of tape 34 from tearing loose from the side walls 12 of the bulk bag 10.

For purposes of clarity, the lengths of fiber reinforced plastic tape 34 and the sections of woven polypropylene fabric 36 which are used to secure the liner 32 to the side walls 12 of the bulk bag 10 are shown positioned at the centers of the side walls 12. In actual practice, however, the lengths of tape 34 and the sections of woven polypropylene fabric 36 which are utilized to secure the liner 32 to the side walls 12 of the bulk bag 10 are preferably located at the corners of the side walls.

Figure 2:
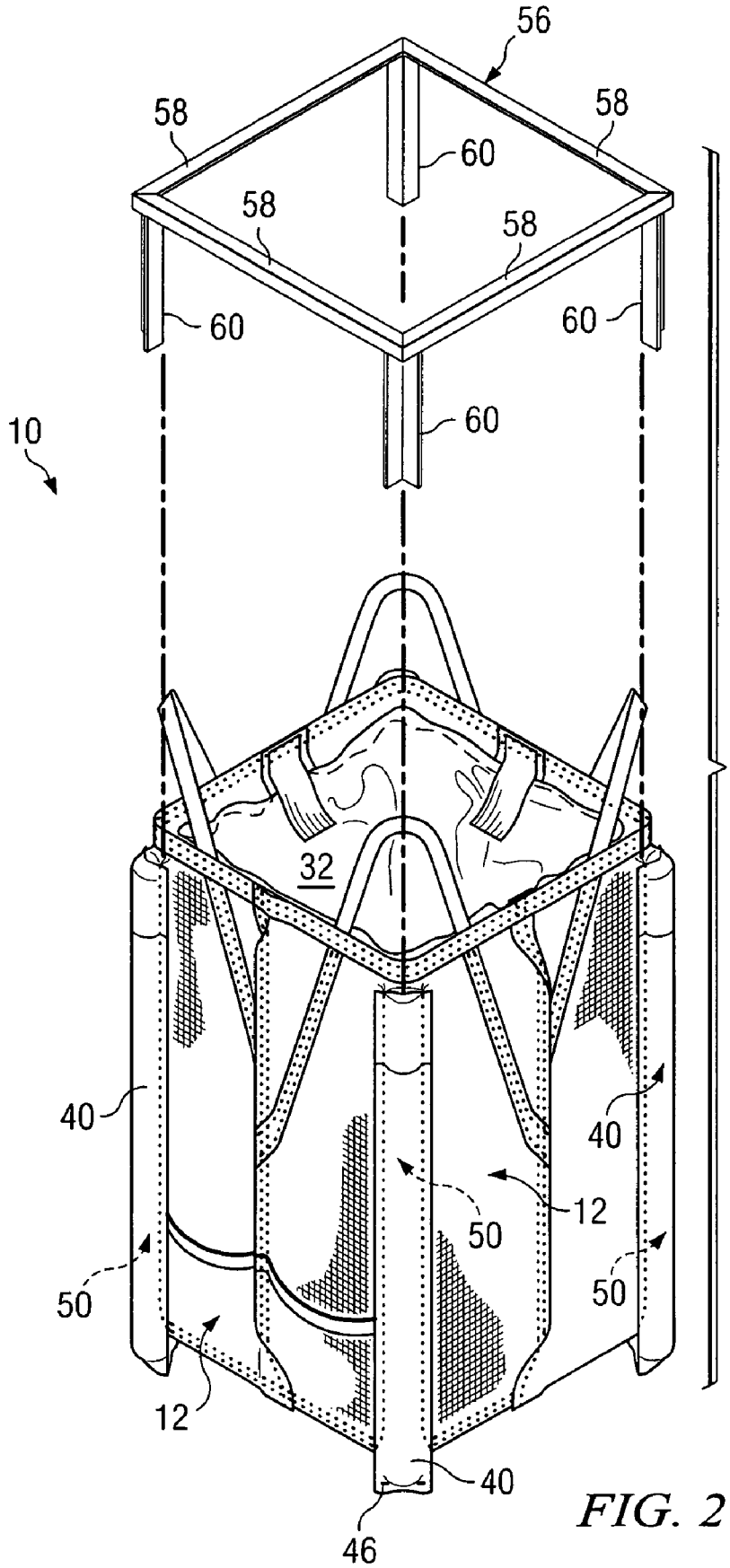
FIG. 2 is an exploded perspective view illustrating the use of a frame in conjunction of the bulk bag of FIG. 1.
Figure 4:
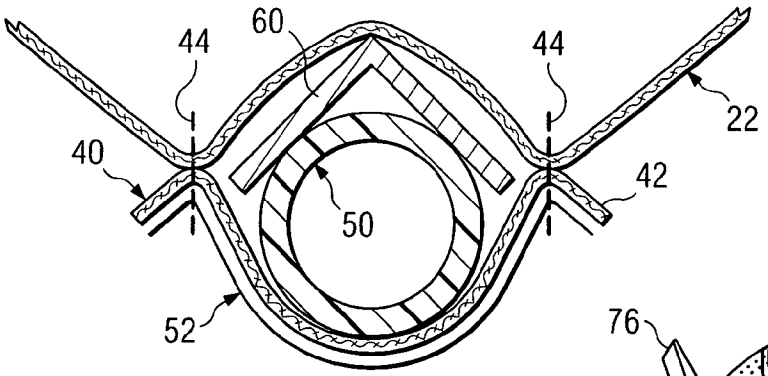
FIG. 4 is a sectional view taken along the line 4—4 in FIG. 3 in the direction of the arrows.
Figure 6:
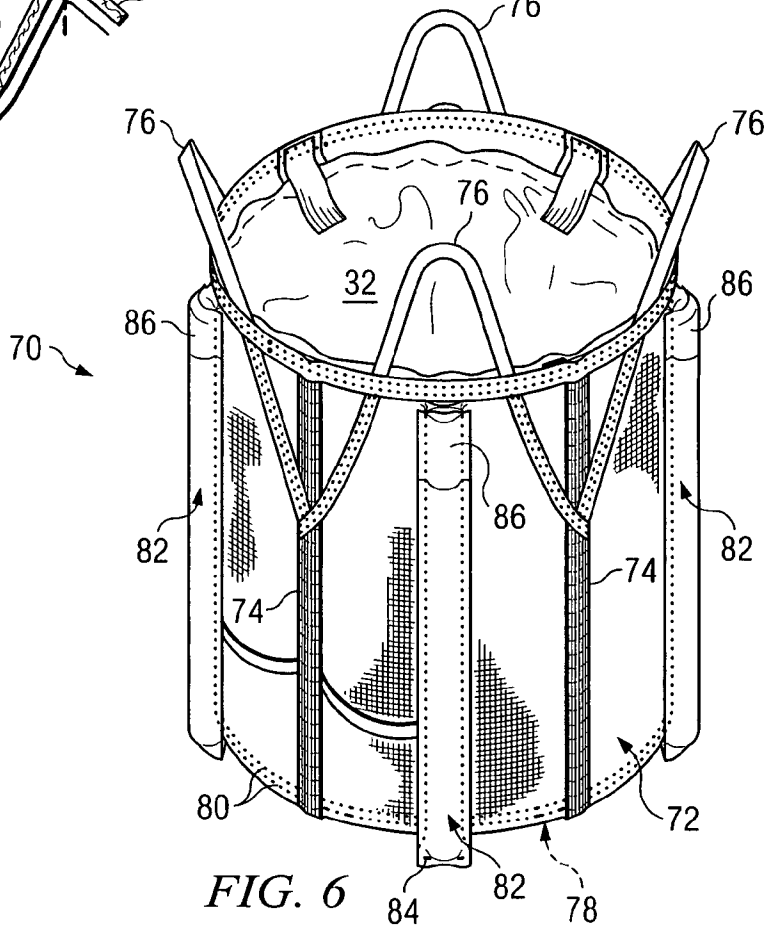
FIG. 6 is a perspective view illustrating a second embodiment of the invention.
Figure 5:
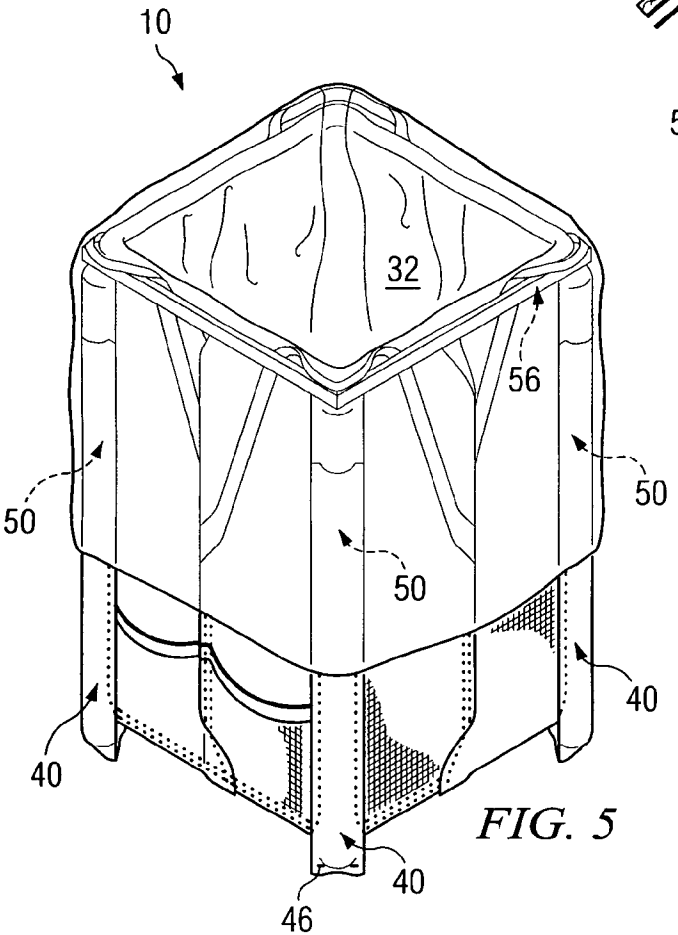
FIG. 5 is a perspective view showing the bulk bag of FIG. 1 ready for filling with meat and meat products.
Figure 7:
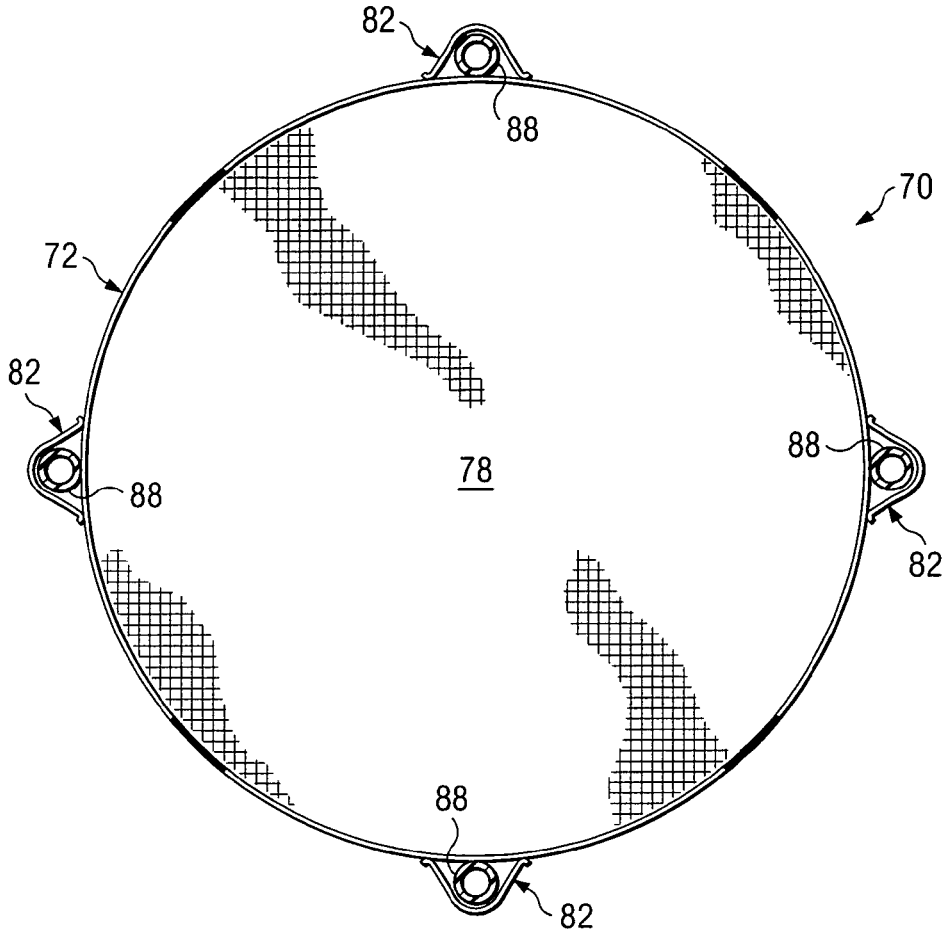
FIG. 7 is a top view of the bulk bag of FIG. 6.

In accordance with the present invention, the bulk bag 10 is provided with support member receiving pockets 40 which are located at the corners of the side walls 12, respectively. Referring particularly to FIG. 4, each pocket 40 comprises a long, narrow strip of woven polypropylene fabric 42 which is secured to the fabric comprising one of the side wall panels 22 by sew lines 44 extending parallel to the corners of the bulk bag. As will be appreciated by those skilled in the art, other types and kinds of fabrics and/or films may be utilized in the construction of the pockets 40 depending upon the requirements of particular applications of the invention. Referring momentarily to FIGS. 1, 2 and 5, the lower end of each pocket 40 is permanently closed by a sew line 46.

Figure 3:
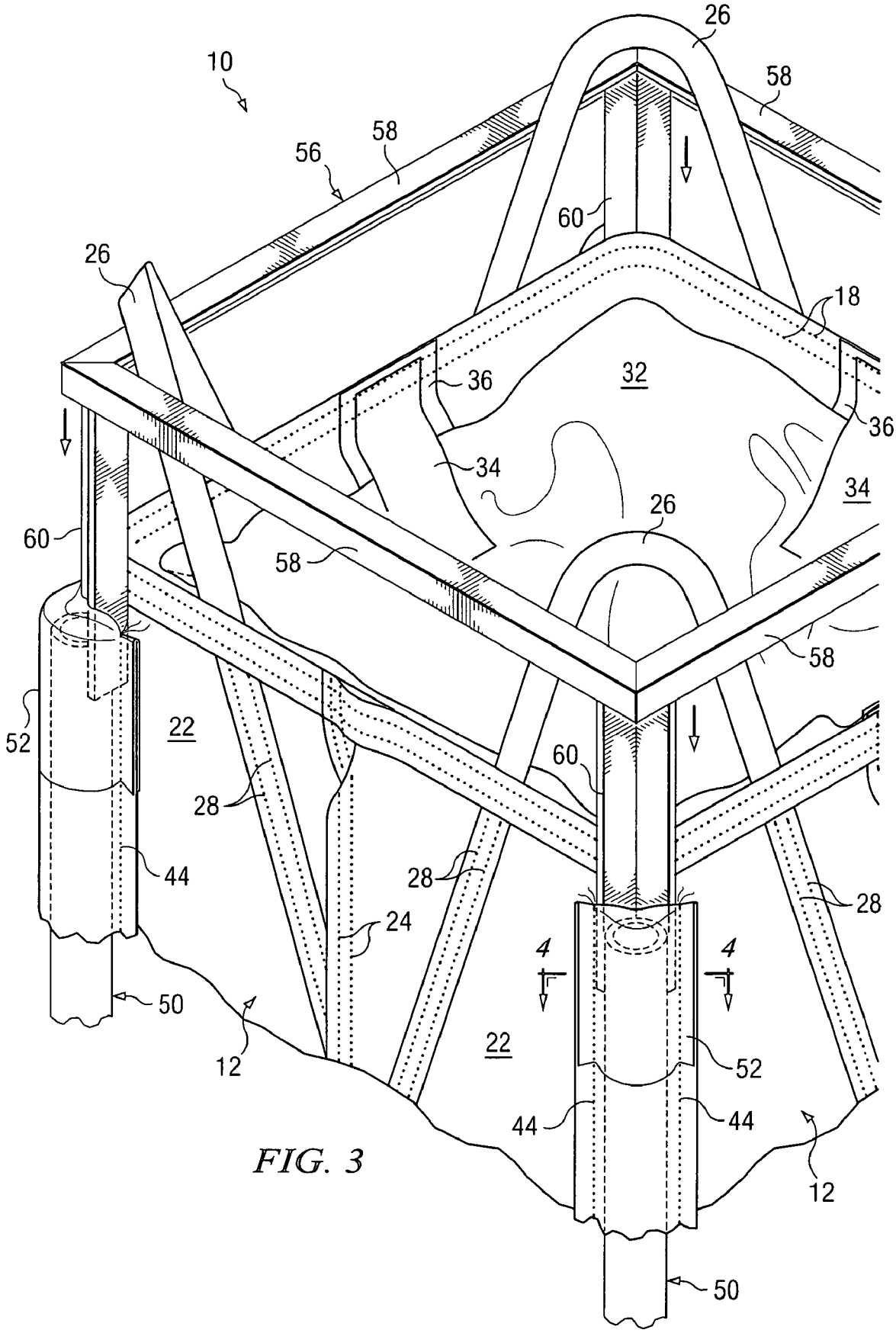
FIG. 3 is a partial perspective view illustrating the bulk bag of FIG. 1 and the use of the frame in conjunction therewith.

As is best shown in FIGS. 3 and 4, each pocket 40 receives a support member 50 which extends substantially the entire length of the pocket. The support member 50 may be formed from PVC pipe, however, other types of plastic pipe, pipe formed from other materials including metals, and solid rods formed from plastics, wood, and other materials may also be utilized in the manufacture of the support members 50. Each support member 50 is permanently retained in its respective pocket 40 by a cover 52 which is secured to the fabric of the side wall panels 22 by the sew lines 44. However, as will become more apparent hereinafter, the upper, inner edge of each cover 52 is open and unsecured.

The function of the support members 50 is to maintain the bulk bag 10 in an upright configuration, that is, to prevent the side walls 12 thereof from collapsing downwardly toward the bottom wall 14. In accordance with the present invention there is also provided a frame 56 the function of which is to prevent the side walls 12 of the bulk bag 10 from collapsing inwardly toward one another. Thus, the frame 56 functions to maintain the bulk bag 10 in a fully open configuration during filling thereof. The frame 56 may be formed from lengths of angle iron formed from steel or any other strong, durable material. The frame 56 may also comprise members having cross-sectional configurations different from the angle iron configuration.

The frame 56 comprises top members 58 which are joined end-to-end and which define a geometrical configuration which is congruent with the geometrical configuration defined by the side walls 12. The frame 56 further comprises legs 60 which extend downwardly from the top members 58. When the angle iron configuration is utilized in the manufacture of the legs 60, the concave sides of the angle irons face outwardly.

As is best shown in FIGS. 2, 3, and 4, the legs 60 of the frame 56 are received in the pockets 40 which also have the support members 50 retained therein. The legs 60 enter the pockets 40 on the interior side thereof relative to the positioning of the support members 50. The legs 60 are extended into the pockets 40 until the top members 58 of the frame engage the upper ends of the side walls 12 comprising the bulk bag 10.

After the legs 60 of the frame 56 are fully seated in the pockets 40 and the top members 58 of the frame 56 are engaged with the upper ends of the side walls 12 of the bulk bag 10, the open end of the liner 32 is pulled out of the interior of the bulk bag 10 and is draped over the upper portions of the exterior surfaces of the side walls 12 of the bulk bag 10 in the manner illustrated in FIG. 5. At this point the bulk bag 10 is fully prepared for the receipt of meat and meat products there within.

Referring to FIGS. 6, 7, 8, and 9, inclusive, there is shown a bulk bag 70 comprising a second embodiment of the invention. The bulk bag 70 is of the type known in the industry as a tubular bulk bag. Like all tubular bulk bags, the bulk bag 70 comprises a unitary side wall 72 comprising a right circular cylinder. The side wall 72 is formed on a circular loom and therefore extends continuously around the periphery of the bulk bag 70 with no seams whatsoever.

The side wall 72 of the bulk bag 70 may be provided with reinforcing strips 74 positioned at spaced apart intervals around the periphery of the bulk bag. If used, the reinforcing strips 74 are formed by adding additional longitudinally extending fibers to the fabric comprising the side walls 72 during the weaving process.

The bulk bag 70 is provided with a plurality of conventional lift loops 76 positioned at 90° intervals around the periphery of the side wall 72. The lift loops 76 are formed from webbing and are secured to the side wall 72 and to the reinforcing strips 74 by sewing. The bulk bag 70 further comprises a bottom wall 78 which is secured to the side wall 72 by sewing along sew lines 80.

In accordance with the present invention the bulk bag 70 is provided with a plurality of support member receiving pockets 82. Each of the pockets 82 is closed at its lower end by sewing along a sew line 84 and is also closed at its upper end by a closure member 86 which is secured in place by sewing after a support member is received in the pocket 82.

The bulk bag 70 is provided with four support members and four support member receiving pockets positioned at 90° intervals around the periphery of the side wall 72. The number of support members and support member receiving pockets can vary depending upon the requirements of particular applications of the invention. In most instances, however, the spacing between adjacent support members and support member receiving pockets is substantially equal around the periphery of the side wall of the bulk bag.

Figure 8:
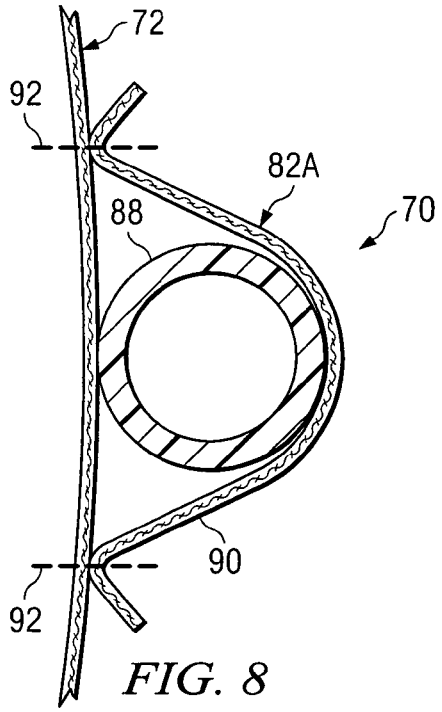
FIG. 8 is an enlargement of a portion of FIG. 7 further illustrating the construction of the bulk bag of FIG. 6.
Figure 9:
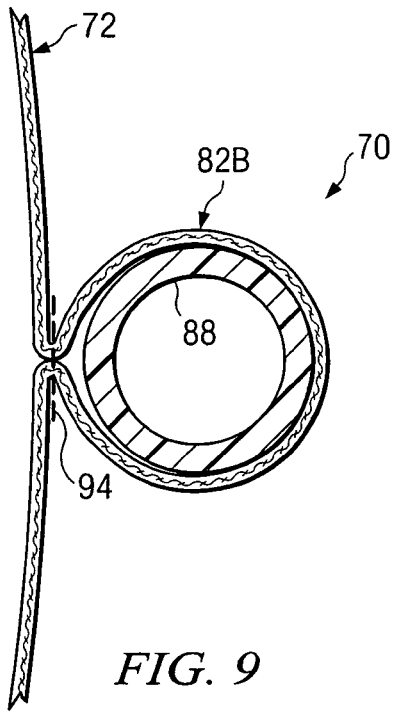
FIG. 9 is a view similar to FIG. 8 illustrating a different construction technique which may be utilized in the manufacture of the bulk bag of FIG. 6.

FIG. 8 illustrates a support member 88 received within a support member receiving pocket 82A which is constructed by securing a length of fabric 90 to the side wall 72 of the bulk bag 70 along sew lines 92. FIG. 9 illustrates a support member 88 received within a pocket 82B which is formed by gathering the material of the side wall 72 of the bulk bag 70 into a more or less circular configuration having an inside diameter slightly larger than the outside diameter of the support member 88 and then securing the gathered portion of the fabric of the side wall 72 by sewing along a sew line 94. Other techniques for constructing the support member receiving pockets of the bulk bag 70 will readily suggest themselves to those skilled in the art.

The bulk bag 70 may be provided with a frame similar to the frame 56 described hereinabove which prevents the bulk bag 70 from collapsing inwardly during filling. If used, the frame for the bulk bag 70 is circular in shape and has an inside diameter equal to or larger than the inside diameter of the bulk bag 70.

Figure 10:
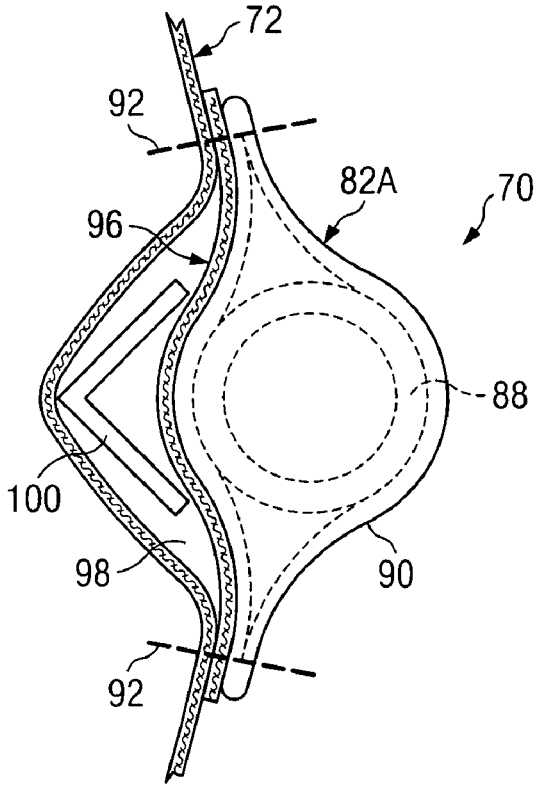
FIG. 10 is a view similar to FIG. 8 showing a modification of the bulk bag construction shown therein.

Referring to FIG. 10 there is shown a modification of the bulk bag construction illustrated in FIG. 8 and described hereinabove in conjunction therewith. FIG. 10 illustrates the length of fabric 90 folded over at the top to secure the support member 88 within the pocket 82A. Thus, the construction of the upper end of the pocket 82A as illustrated in FIG. 10 is similar to the construction of the upper ends of the pockets 40 as illustrated in FIGS. 1 and 2. Both the length of fabric 90 and the fold at the top thereof are secured in place by the sew lines 92.

The bulk bag construction of FIG. 10 differs from the bulk bag construction of FIG. 8 in that an additional length of fabric 96 is secured to the sidewall 72 by the sew lines 92. The length of fabric 96 defines a pocket 98 which receives a length of angle irons 100 depending from a frame. The frame having angle irons 100 depending therefrom is similar to the frame 56 illustrated in FIGS. 1 and 2 but differs therefrom in that it has a circular configuration. The purpose of the frame and the angle irons 100 depending therefrom is to retain bulk bag 70 in an open configuration during filling thereof with meat products.

Figure 11:
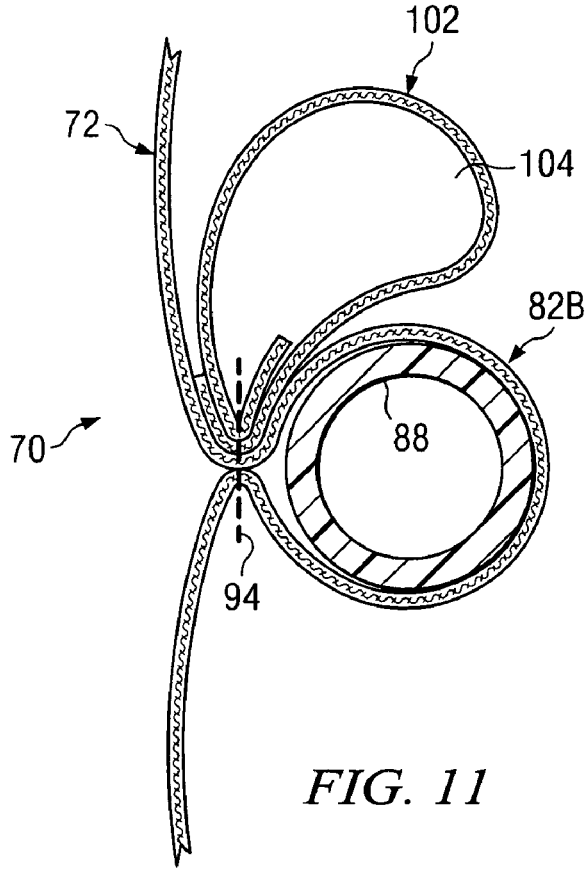
FIG. 11 is a view similar to FIG. 9 showing a modification of the bulk bag construction shown therein.

Referring to FIG. 11 there is shown a bulk bag construction which is similar in many respects to the bulk bag construction illustrated in FIG. 9 and described hereinabove in conjunction therewith. The bulk bag construction of FIG. 11 differs from that of FIG. 9 in that it is provided with an extra length of fabric 102 which is folded over upon itself and secured to the sidewall 72 by the sew line 94. The function of the length of fabric 102 is to define a pocket 104 which receives a length of angle iron similar to the angle iron 100 illustrated in FIG. 10. The length of angle iron which is received in the pocket 104 depends from a circular frame with similar construction to the frame 56 illustrated in FIGS. 1 and 2 and described hereinabove in conjunction therewith. The function of the frame and angle irons depending therefrom is to hold the bulk bag 70 in an open configuration during the filling thereof with meat and meat products.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A bulk bag comprising:

a side wall having upper and lower ends and defining a cylindrical configuration;

a bottom wall secured to the lower end of the side wall;

the side wall and the bottom wall defining the interior of the bulk bag;

a liner secured within the interior of the bulk bag as defined by the side wall and the bottom wall;

a plurality of pockets each located at spaced apart locations around the periphery of the bulk bag;

a plurality of support members each received within one of the pockets and extending substantially the entire length thereof for retaining the bulk bag in an upright configuration; and a frame having a plurality of legs depending therefrom which are equal in number to the number of pockets comprising the bulk bag, and wherein the bulk bag further comprises additional pockets for receiving the legs of the frame whereby the frame retains the bulk bag in an open configuration during filling.

2. A bulk bag comprising:

a side wall having upper and lower ends defining a cylindrical configuration;

the side wall comprising a woven polypropylene fabric side wall panel;

a bottom wall secured to the lower end of the side wall;

the side wall and the bottom wall defining the interior of the bulk bag;

a liner formed from polyethylene film secured within the interior of the bulk bag as defined by the side wall and the bottom walls;

pockets located at spaced apart locations around the periphery of the bulk bag;

each of the pockets comprising a long, narrow woven polypropylene fabric strip secured to the woven polypropylene fabric comprising the side wall by sew lines;

support members each formed from PVC pipe and each received within one of the pockets defined by the side walls and extending substantially the entire length thereof for retaining the bulk bag in an upright configuration; and a frame having a plurality of legs depending therefrom which are equal in number to the number of pockets comprising the bulk bag, and wherein the bulk bag further comprises additional pockets for receiving the legs of the frame whereby the frame retains the bulk bag in an open configuration during filling.

* * * * *